United States Patent [19]

Edo

[11] 4,261,669

[45] Apr. 14, 1981

[54] METHOD AND APPARATUS FOR REPAIRING ASPHALT CONCRETE PAVED ROAD SURFACE

[76] Inventor: Yasuo Edo, No. 32-15, 1-chome, Ooi, Shinagawa-ku, Tokyo, Japan

[21] Appl. No.: 27,896

[22] Filed: Apr. 6, 1979

[30] Foreign Application Priority Data

Jun. 5, 1978 [JP] Japan ..... 53/66765

[51] Int. Cl.[3] ..... E01C 7/06

[52] U.S. Cl. ..... 404/77; 404/79; 404/95

[58] Field of Search ..... 404/77, 79, 95, 91

[56] References Cited

U.S. PATENT DOCUMENTS

| | | | |
|---|---|---|---|
| 711,115 | 10/1902 | Lober | 404/79 X |
| 942,866 | 12/1909 | Popkess | 404/91 |
| 1,354,076 | 9/1920 | Stephens | 404/91 |
| 1,634,264 | 7/1927 | McHnerney | 404/79 |
| 1,997,959 | 4/1935 | Wood | 404/91 |
| 2,394,017 | 2/1946 | Seaman | 404/91 X |
| 2,397,613 | 4/1946 | Madsen | 404/91 X |
| 2,747,475 | 5/1956 | West | 404/91 |
| 3,361,042 | 1/1968 | Cutler | 404/77 |
| 3,970,404 | 7/1976 | Benedetti | 404/77 |
| 3,997,276 | 12/1976 | Jackson | 404/77 |

*Primary Examiner*—Nile C. Byers, Jr.
*Attorney, Agent, or Firm*—Holman & Stern

[57] ABSTRACT

This invention relates to a method and apparatus for repairing asphalt concrete road surfaces wherein a tractor a steam box and a car mounted with a screw cutter are coupled in this order and a series of linearly operated equipment is used on the asphalt concrete paved road surface, including a heater car, an asphalt finisher and a road roller in this order after the car. Each of the equipment is made to advance at low speed and the asphalt concrete paved road surface is artificially heated by the steam box to impart fluidity to the road surface, after which it is cut with the screw cutter and the cut asphalt concrete is conveyed into a heating chamber of the heater car, and water content in the asphalt concrete is removed by heating and stirring. The resulting asphalt concrete is adjusted to an optimum temperature suitable for asphalt concrete paving, and then is discharged from the heating chamber, and charged onto the surface of the cut road directly and thereafter the asphalt concrete paved road surface is teated by using the asphalt finisher and the road roller.

3 Claims, 7 Drawing Figures

METHOD AND APPARATUS FOR REPAIRING ASPHALT CONCRETE PAVED ROAD SURFACE

BRIEF SUMMARY OF THE INVENTION

The present invention relates to a method of repairing road surface, and more particularly to a method of repairing an asphalt concrete paved road surface and to an apparatus for carrying out the method.

At present, a paved road of asphalt concrete generates concave and convex portions on the paved road surface vertically and horizontally due to increasing size of traveling vehicles and increasing traffic volume. The thus produced irregular surface then causes drainage and other problems such as maintenance of the road and in many instances causes accidents of the traveling vehicles. The problems tend to occur particularly in the summer season, and this is a drawback of the asphalt concrete. Straight asphalt is solidified at room temperature and when heated, it starts to become fluid gradually at about 50° C., a property which is inherent in asphalt concrete and is an inevitable phenomenon.

The conventional method for repairing an asphalt concrete paved road surface is such that an entire surface of vehicle lanes where concave and convex portions are generated is cut with a cutter in a thickness of 5–10 cm, and an asphalt mixed material is newly applied to pave the road. This method has the drawbacks that it requires an enormous amount of expenses in carrying the cut pieces to dumping locations and processing thereof in addition to the cutting expense and paving expense, and moreover the repair work cannot be done in and extremely short time with respect to a term of works.

The present invention has succeeded in solving the problems of conventional methods almost completely.

An object of the present invention is to provide a method and an apparatus for repairing an asphalt concrete paved road surface including salvaging all the asphalt concrete cut from the road surface to be repaired in a continuous process.

Another object of the present invention is to salvage all the asphalt concrete without leaving any pieces and to eliminate all the processing expenses of carrying the cut asphalt to dumping locations and dumping them, and to reduce the repairing expenses to a minimum.

A further object of the present invention is to perform the repair of the asphalt concrete paved road surface by a consistent mechanical process in a short time, to shorten the term of each job.

Other objects, features and advantages of the present invention will be thoroughly obvious from the following description.

DETAILED DESCRIPTION

The present invention has been accomplished by recognizing the fact that the quality of the aggregate and straight asphalt which are ingredients of the asphalt concrete does not greatly change over the years, and utilizing another quality advantageously which is that the straight asphalt is solidified at room temperature and when heated, it fluidizes gradually at about 50° C.

In the present invention, in order to achieve the method of the invention efficiently, the apparatus of the invention is disposed on the surface of the asphalt concrete paved road so as to be moveable linearly. Each equipment of the apparatus is arranged in such a manner that a tractor positioned at its head pulls the steam box B and the car D mounted with the screw cutter C, and behind the car D, the heater car E, asphalt finisher F and road roller G are arranged in this order, and while each of the equipment moves forward at slow speed, each equipment is operated simultaneously to perform repair work of the surface of the asphalt concrete paved road.

Hereinafter, the repair work of the present invention will be described in details according to the order of the steps of the process.

A first process of the present invention is a heating process for heating the surface of the asphalt concrete paved road and imparting fluidity by heating the concrete artificially.

As a method of heating the surface of the asphalt concrete paved road artificially, generally, a direct heat type heating method is used but in order to impart fluidity to the asphalt concrete by using this direct heat type heating method, the concrete must be in fluid condition to a depth of about 10 cm from the surface. But when the fluidity is obtained to such a degree, the oiliness of the straight asphalt on the surface is burnt, and the quality of the asphalt is lost and therefore the direct heat type heating method cannot be employed in the method of the present invention.

Under the circumstances, the present inventor adopted a steam produced heating method using heated steam by a steam boiler as a method of heating without changing the quality of the asphalt. The present invention employing the steam heating method as the first heating process is described in greater detail below with reference to the drawings.

Figure 1:
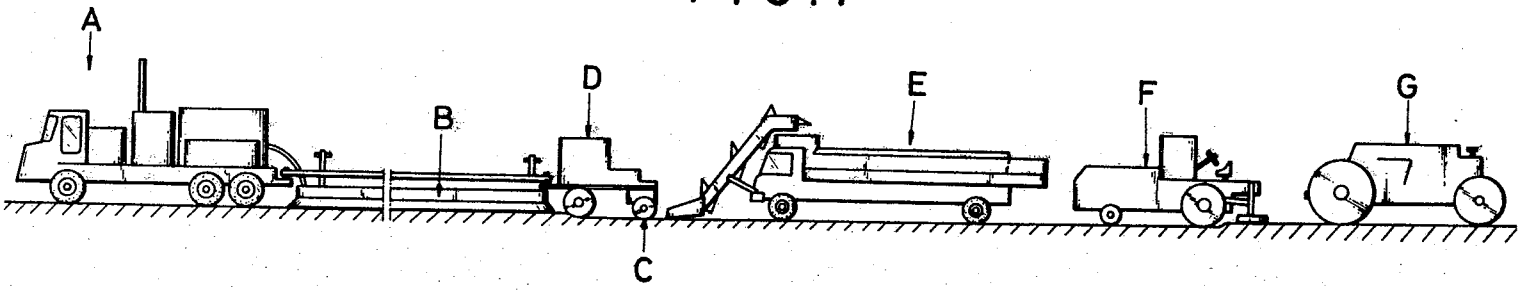
FIG. 1 is a schematic side view showing an arrangement of asphalt concrete paved road surface repairing apparatus on the road according to the present invention, FIG. 2 schematic side view showing a steam box of FIG. 1 being pulled by a tractor and a car.
Figure 2:
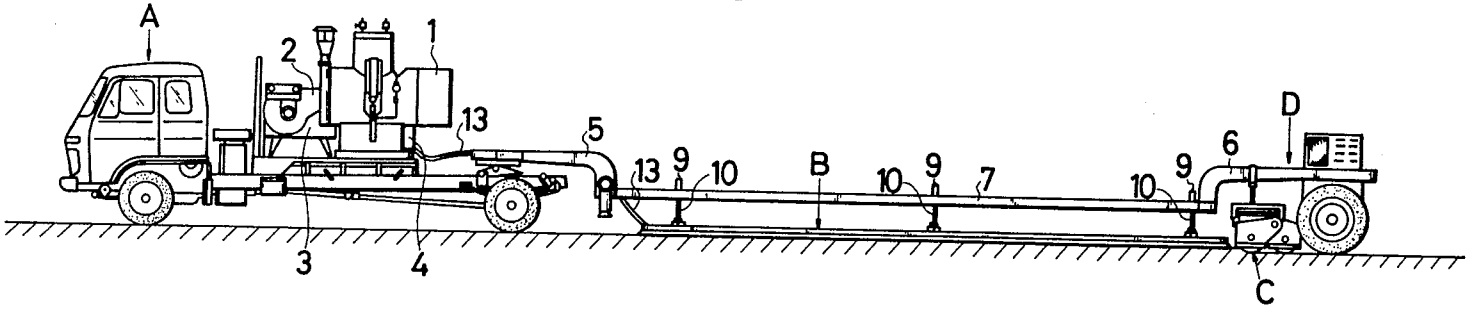
Figure 3:
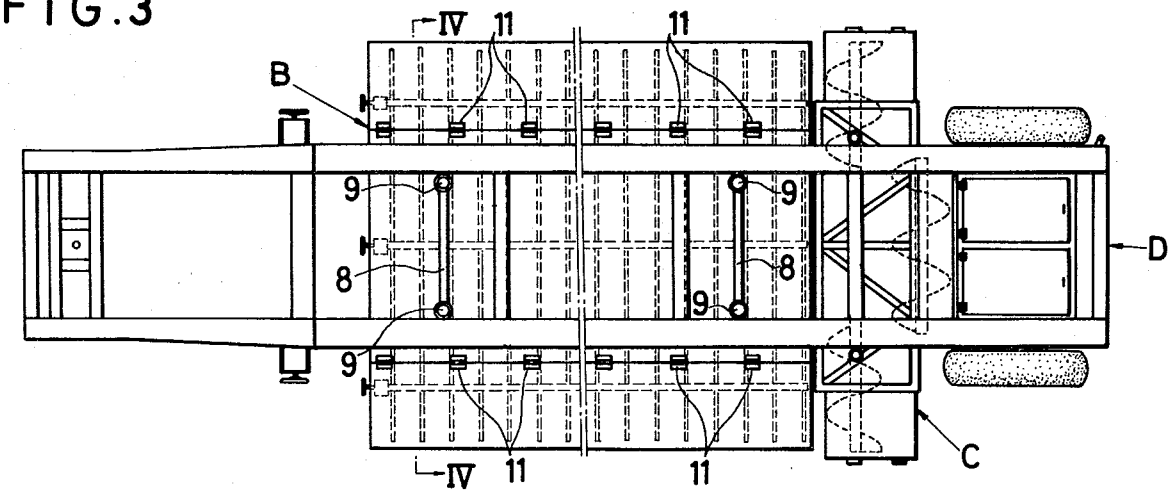
FIG. 3 is a plan showing the steam box and the car.
Figure 4:
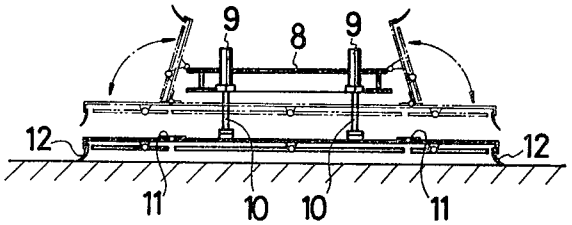
FIG. 4 is a vertical cross section of the steam box of FIG. 3 showing condition of the steam box in broken lines wherein the steam box is shifted upward by hydraulic cylinders and the sides are raised upward by means of hinges.
Figure 7:
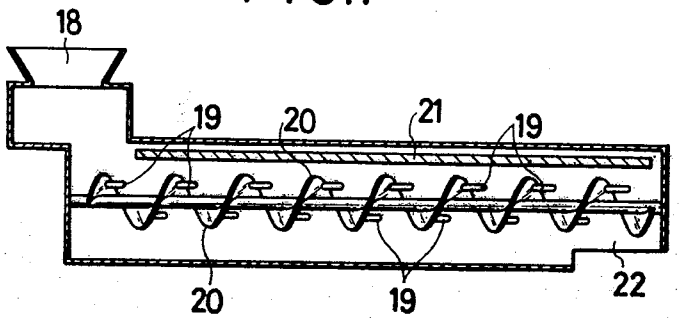
FIG. 7 is a vertical cross section view of a heating chamber.
Figure 5:
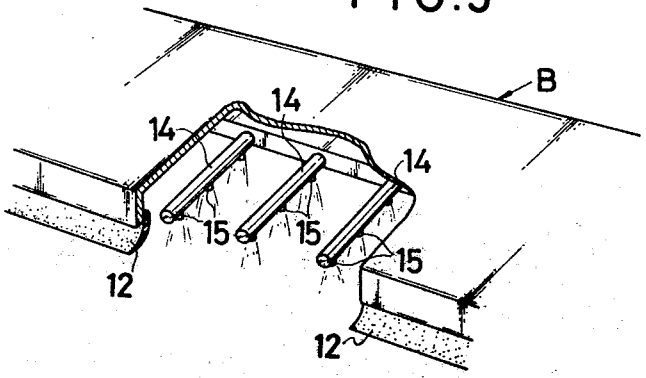
FIG. 5 is a perspective view showing the steam box with certain parts cut away.
Figure 6:
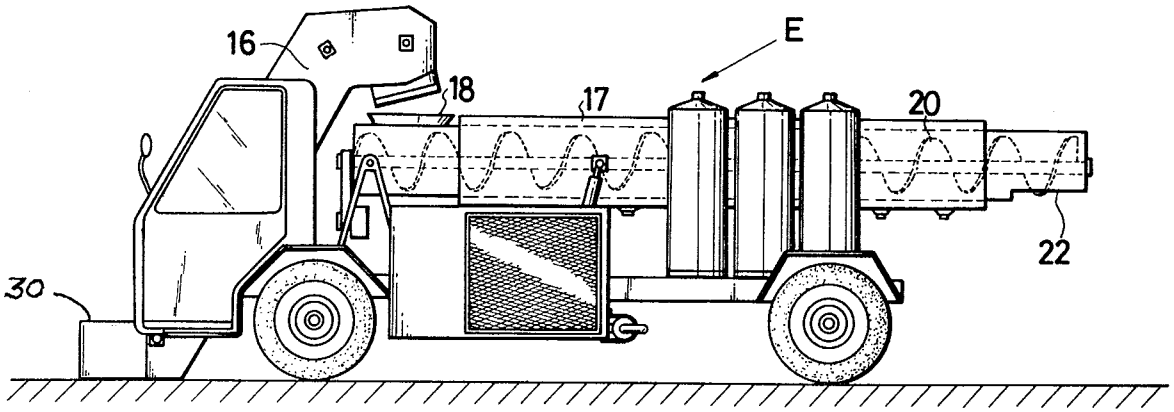
FIG. 6 is a side elevation view of a heater car.

Initially, if necessary, impurities on the surface of the asphalt concrete paved road are washed off by the jet pressure of water before the first heating process is started, but if the impurities are not present or are of small quantity, such washing is not necessary. The tractor A disposed at the head of the apparatus of the present invention as shown in the drawing is a vehicle of the type that is adapted for low speed traveling, and this tractor A has mounted thereon a steam boiler 1, burner 2, fuel tank 3 and water tank 4 a goose-neck type frame 5 for coupling is mounted on the rear part of the tractor A. To the rear of the tractor A, a car D has disposed which is mounted thereon a screw cutter C for cutting the asphalt concrete paved road on its under surface. In the front part of the car D, a coupling frame 6 for is mounted similar to the frame 5 and a holding frame 7 is positioned between A and the car D, and the tractor is connected at its ends to the frames 5 and 6 so that the car D is pulled, while holding the holding frame 7 with the tractor A. Hydraulic cylinders 9 are mounted substantially vertically on plates 8 fixed in spaced relationship to the holding frame 7. The hydraulic cylinders 9 are of a conventional type having an internal piston with a rod or shaft 10 extending through one end thereof. The lower ends of shafts 10 of the hydraulic cylinders 9 are connected to the top of the steam box B so that and the steam box B can be moved vertically through the operation of the hydraulic cylinders 9. This steam box B may be constructed in such a way that the box itself is mounted with tires to be pulled separately from the car D. Also, steam box B may be constructed in three longitudinal sections comprising a central section and two side sections, the side sections being connected to the central section hinges 11 to the central section to allow both sides to fold upward as shown in FIG. 4, to reduce the width so that it can be advantageously moved between various job sites. The steam box B has an inverted concave cross section, and has a length and width sufficient to cover and heat the surface of the asphalt concrete paved road, and its size may vary depending on the width of the road surface to be repaired. As a standard size, a box having the length of 5 m–8 m and a width of 2.5 m–3 m may be recommended. Also, according to necessity, two or three coupled steam boxes B may be used. During the heating of the surface of the asphalt concrete paved road, the bottom edges of four sides of the steam box B are positioned slightly above the road surface adjusted by the hydraulic cylinders 9. At the bottom edges of the four sides of the steam box B, a heat resistant rubber plate 12 having high elasticity is suspended, (best shown in FIGS. 4 and 5) and this heat resistant rubber plate 12 contacts the road surface and the concave and convex surfaces of the road, and also encloses the inside of the steam box B and the atmosphere to enhance the heating effect. Moreover, in the upper part of the inside of the steam box B, pipes 14 (as shown in FIG. 5) are supported by a duct system communicating with the steam boiler 1 mounted on the tractor A through a coupling hose 13. On the lower surfaces of pipes 14, a plurality of jet nozzles 15 for heated steam are provided directed toward the road surface. The heated steam of about 100° C.–120° C. heated by the steam boiler is ejected through nozzles 15 toward the road surface to heat and soften it.

The surface of the asphalt concrete paved road heated by the steam through the jet nozzles 15 starts to soften about 10 cm–12 cm from the surface when the road surface temperature reaches about 100° C. whereby the concrete becomes a fluid material. It is necessary that the temperature of the the heated steam ejected by the jet nozzles 15, jet time and, traveling speed of the tractor A are properly adjusted depending on atmospheric temperature, drying conditions and conditions at the site of the repair work.

After heating the paved road surface the cutting process is performed by the screw cutter C provided on the car D pulled behind the steam box B both moving forward at low speed. When the road surface has sufficient fluidity it is cut by means of the screw cutter C to a depth of about 10 cm–12 cm from the surface and is broken into pieces with ease.

After the cutting step which is the second step salvaging of the asphalt concrete is commenced as a third process. The salvaging process is performed by the heater car E disposed behind car D which moves forward at low speed. The heater car E has mounted thereon a bucket conveyor 16 having a forward scoop or nozzle 30 which picks up the pieces produced by screw cutter C of the car D, and a heating chamber 17 for heating the asphalt concrete pieces. The heating chamber 17 is of rectangular shape, and a charge opening 18 is provided at a position under the upper discharge end of the bucket conveyor 16. In the lower part of the inside of the heating chamber 17, a screw conveyor 20 is provided with blades 19 for stirring, and in the upper part of the inside of the heating chamber 17, an infrared heater 21 made of chrome steel using LPG gas is mounted. However, the asphalt concrete cut in the cutting process picked up by the bucket conveyor 16 and charged into the heating chamber 17 through the charge opening 18 contains a high water content, and is heated by heater 21 emitting heat at 500° C.–600° C. to accelerate the softening remove the water. The charged material is stirred by the screw conveyor 20 provided with the blades 19, and while it is broken into pieces, the concrete is transferred to the rear part. When the asphalt concrete is heated for about 3 minutes in the heating chamber 17, the asphalt that binds the aggregate firmly gradually becomes transformed to a sludge condition and is discharged as the salvaged material through a discharge opening 22 provided at the lower surface of the rear part of the heating chamber 17. The temperature of the salvaging material at that time is required to be adjusted to 160° C.–170° C. which is an optimum temperature suitable for resurfacing the asphalt concrete pavement.

After the salvaging process, which is the third process, a leveling process, which is a fourth process. The leveling process, is commenced is performed by the asphalt finisher F disposed behind the heater car E. The slavaged material obtained in the salvaging process which is discharged through the discharge opening 22 at the rear part of the heating chamber 17 is immediately charged into depressed portions of the road surface cut in the cutting process and is leveled by the asphalt finisher F. After the leveling process a road rolling process is commenced which is a fifth process. The road rolling process is performed by the road roller G disposed behind the asphalt finisher F. The surface of the salvaged asphalt concrete which is leveled in the leveling process is rolled by the road roller G, whereby the repairing work of the asphalt concrete paved road surface is completed.

The foregoing process is a process related to the complete repairing work of the asphalt concrete paved road surface, but there are cases where the road surface is cut and broken pieces of the concrete are discarded without salvaging depending on the condition of the paved road surface. In accordance with the foregoing processes, the broken pieces of the concrete are removed by only employing the heating process and cutting process, and only the concave and convex surfaces of the road are repaired. However, if the concave and convex surfaces are of small size such as 1 cm–3 cm, still in accordance with the foregoing processes, the cutting process, salvaging process and the leveling process are omitted and the repair of the road surface may be performed by only the heating process and the road rolling process.

The present invention has been described in the foregoing for repairing an asphalt concrete paved road surface by cutting the asphalt concrete paved road surface, salvaging it, and recharging the salvaged material to the cut portion of the road surface so that there is no need of carrying and dumping the cut and broken pieces of the concrete to dumping locations as experienced in the conventional methods, and moreover, there is no need of using fresh asphalt mixed material. However, the condition of the repaired road surface can be compared with the road completed with the use of the fresh asphalt mixed material. Also, in the present invention, the repair work of the road surface is completed in a continuous mechanical process, and the time of repairs is greatly shortened as compared with the conventional methods. Accordingly, applicant's invention reduces the expenses of this work while increasing the profit by allowing the repair of the road surface by a continuous process through salvaging of the cut asphalt concrete from paved road without using the fresh asphalt materials at all since such straight asphalt material and aggregates are becoming expensive raw materials. As it has been scientifically proven that asphalt remains unchanged in its quality over long periods of time from B.C. to the present in Egypt, the working of the present invention can contribute to saving natural resources and energy, and meet with the international demands.

Moreover, with respect to the quality of the asphalt concrete salvaged by using the heated steam, it was evidenced in the embodiment of Japanese Pat. No. 903,555 (title of invention: Method of Salvaging Asphalt Concrete) obtained by the present inventor in Japan, that the quality of the salvaged concrete is comparable to fresh asphalt mixed material.

What is claimed is:

1. A method of repairing an asphalt concrete paved road surface comprising the steps of providing a steam box covering the surfaces of the road to be treated, supporting the front end of said steam box on a wheeled tractor and the rear end on a wheeled car so that said steam box and car can be pulled along the road surface at a predetermined speed by said tractor, pulling said steam box and car at a predetermined speed over said road surface, providing a boiler on said tractor to generate steam, feeding said steam to a pipe and nozzle system in said steam box, directing said steam through said nozzles onto the road surface to heat and soften said surface until it becomes fluidized, breaking up said heated surface into pieces by a cutting means carried by said car, picking up said pieces by a mobile bucket conveyor carried on the front of a mobile heating car moving at approximately said predetermined speed, conveying said pieces by said conveyor to a mobile heating chamber carried on said heating car, heating said pieces in said heating chamber by a heating means emitting heat at about 500° C. to 600° C. to soften and dehydrate said pieces to transform them into a fluid mass of asphalt concrete suitable for repairing the road surface being treated, stirring and moving said pieces and mass of asphalt concrete through said heating means by a screw conveyor to the rear of said heating car, redepositing said mass of asphalt concrete onto said road surface being treated, leveling said redeposited asphalt concrete with an asphalt finishing machine moving at approximately said predetermined speed, and rolling said leveled redeposited asphalt concrete with a road roller to complete the treatment of said road surface, said process being continuous.

2. An apparatus for repairing the surface of an asphalt concrete paved road including a heating means for heating the road surface coupled to a tractor and supported over the road surface at its front end by the tractor and at its rear end by a wheeled vehicle means, the improvement wherein said heating means comprises a rectangular shaped steam box having a flat top and depending sides, heat resistant rubber sealing elements of high elasticity attached to the lower edges of said sides adapted to engage the road surface when in use, a steam conduit system supported within said box comprising an array of interconnected pipes, steam jet nozzles on the lower sides of said pipes directed downwardly and arranged to eject steam onto substantially the entire surface of the road covered by said steam box, means to support said steam box for vertical adjustment comprising a frame member attachable at its front end to a coupling member which is attachable to a tractor, said frame member being coupled at its rear end to the wheeled vehicle, hydraulic cylinders with extendable rods mounted on said frame with said extendable rods directed substantially vertically below said frame member, the lower ends of said rods being connected to said steam box, means mounted on said frame to operate said hydraulic cylinders to selectively raise and lower said steam box, a steam generating means having a steam outlet carried on said tractor, means connecting said steam outlet to said array of pipes of said steam box to be ejected through said nozzles onto the road surface, a screw cutter mounted on said wheeled vehicle at the rear of said steam box, and means operatively associated with said vehicle to drive said screw cutter to cut up into pieces the road surface heated by said steam box.

3. The road repairing apparatus as claimed in claim 2 further comprising said steam box being constructed in three sections, a central section supported on said frame member and two side sections, hinge means for attaching said side sections to said central section so that said side sections can be raised up and supported above said central section to reduce the width of said steam box to facilitate transporting it between job sites.

* * * * *